US006253716B1

(12) United States Patent
Palmer et al.

(10) Patent No.: US 6,253,716 B1
(45) Date of Patent: Jul. 3, 2001

(54) CONTROL SYSTEM FOR COOLING FAN ASSEMBLY HAVING VARIABLE PITCH BLADES

(75) Inventors: Bradford Palmer, Minneapolis, MN (US); Xin Feng, Brookfield, WI (US); Chris Nelson, Edina, MN (US)

(73) Assignee: Horton, Inc., Minneapolis, MN (US)

( * ) Notice: Subject to any disclaimer, the term of this patent is extended or adjusted under 35 U.S.C. 154(b) by 0 days.

(21) Appl. No.: 09/349,274

(22) Filed: Jul. 7, 1999

(51) Int. Cl.[7] ..... F01P 7/02

(52) U.S. Cl. ..... 123/41.12; 123/41.49; 416/36

(58) Field of Search ..... 123/41.11, 41.12, 123/41.49, 41.65; 416/38, 36

(56) References Cited

U.S. PATENT DOCUMENTS

| | | | | |
|---|---|---|---|---|
| 1,456,699 | | 5/1923 | Kramer . | |
| 1,489,841 | | 4/1924 | MacDonald . | |
| 1,491,589 | | 4/1924 | Dzus | 416/60 R |
| 1,496,496 | | 6/1924 | Silick . | |
| 1,650,776 | | 11/1927 | Stock . | |
| 1,668,408 | | 5/1928 | Johnson . | |
| 1,856,578 | | 5/1932 | Miguel et al. . | |
| 1,857,319 | | 5/1932 | Monroe | 416/61 |
| 2,132,133 | * | 10/1938 | Smith | 123/41.11 |
| 2,146,367 | | 2/1939 | Berliner | 416/167 |
| 2,225,209 | * | 12/1940 | Dewrey | 123/41.11 |
| 2,479,668 | | 8/1949 | Brandon et al. . | |
| 2,880,809 | | 4/1959 | Wagner . | |
| 3,054,458 | | 9/1962 | Marisco . | |
| 3,217,808 | * | 11/1965 | Elmer | 123/41.35 |
| 3,294,175 | | 12/1966 | Bodner . | |
| 3,388,694 | | 6/1968 | Elmer . | |

(List continued on next page.)

FOREIGN PATENT DOCUMENTS

| | | | |
|---|---|---|---|
| 463006 | 11/1968 | (CH) . | |
| 640941 | 1/1984 | (CH) . | |
| 1403104 | 10/1968 | (DE) . | |
| 195 22 840 | 1/1996 | (DE) . | |
| 576046 | 3/1946 | (GB) | 416/61 |
| 716389 | 10/1954 | (GB) | 416/168 R |
| 880281 | 10/1961 | (GB) | 416/168 R |
| 57-46091 | 3/1982 | (JP) | 416/167 |
| 58-2111598 | 12/1983 | (JP) . | |
| 5187861 | 7/1993 | (JP) . | |
| 8809447 | 12/1988 | (WO) | 123/41.49 |
| 9009522 | 8/1990 | (WO) . | |

OTHER PUBLICATIONS

Machinery's Handbook, 10$^{th}$ ed. New York, Industrial Press, 1939, p. 516.

*Primary Examiner*—Willis R. Wolfe
*Assistant Examiner*—Katrina B Harris
(74) *Attorney, Agent, or Firm*—Kinney & Lange, P.A.

(57) ABSTRACT

A fan assembly (10) which incorporates variable pitched blades (152), is driven by the engine of a vehicle and is used in cooling the engine. A control system (248) is provided which is responsive to at least one signal representative of an operating parameter of the engine and a second signal indicative of a desired cooling requirement to establish an efficient pitch for the blades of the fan assembly. In one embodiment, the speed of the engine is sensed and used in combination with a cooling requirement signal developed by the engine control module (205) to regulate the pitch of the fan assembly. In a second embodiment, engine charge air temperature and coolant temperature signals are utilized in establishing the desired pitch. Furthermore, fuzzy logic controls (290) can be utilized to anticipate the cooling needs of the engine based on variations in the overall dynamic system as derived from information available through the engine control module.

22 Claims, 7 Drawing Sheets

U.S. PATENT DOCUMENTS

| | | | | |
|---|---|---|---|---|
| 3,505,982 | | 4/1970 | Walter et al. . | |
| 3,599,904 | | 8/1971 | Condit et al. . | |
| 3,647,320 | | 3/1972 | Chilman et al. . | |
| 3,731,515 | | 5/1973 | Master et al. . | |
| 3,844,680 | | 10/1974 | Saterdal . | |
| 3,853,427 | | 12/1974 | Holt . | |
| 3,860,361 | | 1/1975 | McMurtry et al. . | |
| 3,932,054 | | 1/1976 | McKelvey | 416/168 R |
| 4,037,986 | | 7/1977 | Chilman . | |
| 4,082,378 | | 4/1978 | Gries . | |
| 4,124,330 | | 11/1978 | Barnes . | |
| 4,187,056 | | 2/1980 | Schwinn et al. . | |
| 4,206,892 | | 6/1980 | MacCready, Jr. et al. . | |
| 4,219,310 | | 8/1980 | Takata et al. . | |
| 4,305,491 | * | 12/1981 | Rohrer | 192/58 B |
| 4,427,339 | | 1/1984 | Witzel . | |
| 4,461,340 | | 7/1984 | Hart et al. . | |
| 4,546,742 | | 10/1985 | Sturges | 123/41.05 |
| 4,619,586 | | 10/1986 | Carter . | |
| 4,789,305 | | 12/1988 | Vaughen . | |
| 4,792,279 | | 12/1988 | Bergeron . | |
| 4,924,161 | | 5/1990 | Ueki et al. . | |
| 4,927,329 | | 5/1990 | Kliman et al. | 416/127 |
| 4,990,205 | | 2/1991 | Barbier et al. . | |
| 5,022,821 | | 6/1991 | Isert . | |
| 5,122,034 | | 6/1992 | Isert . | |
| 5,207,557 | | 5/1993 | Smiley, III et al. . | |
| 5,209,640 | | 5/1993 | Moriya | 416/36 |
| 5,259,729 | | 11/1993 | Fujihira et al. . | |
| 5,281,095 | | 1/1994 | Komura et al. | 416/167 |
| 5,284,420 | | 2/1994 | Guimbal . | |
| 5,299,911 | * | 4/1994 | Moriya | 416/35 |
| 5,403,161 | | 4/1995 | Nealon et al. . | |
| 5,482,584 | | 1/1996 | Herrmann et al. . | |
| 5,531,190 | | 7/1996 | Mork | 123/41.12 |

* cited by examiner

CONTROL SYSTEM FOR COOLING FAN ASSEMBLY HAVING VARIABLE PITCH BLADES

BACKGROUND OF THE INVENTION

The present invention pertains to cooling systems and, more particularly, to a fan assembly incorporating blades which may be adjusted to vary the pitch thereof in order to alter the airflow characteristics of the fan assembly. The invention is specifically directed to a control system for use in regulating the blade pitch of such a fan assembly, as well as a method of controlling the pitch of the fan assembly, to develop an optimal airflow based on sensed operating conditions.

Providing a fan assembly including a plurality of circumferentially spaced blades for developing a flow of air for cooling purposes is well known. Such fan assemblies are widely used in numerous fields, such as for cooling heat generating devices. For example, in the automotive art, fan assemblies are commonly used for engine cooling purposes. More specifically, a fan assembly is generally attached to a block of the internal combustion engine and is driven by the engine through a sheave and belt drive arrangement. The fan assembly mainly delivers a flow of air across a radiator and is incorporated as part of an overall, thermostatically controlled engine cooling system.

Since the fan assembly is driven by the engine, the rotating speed of the fan blades tracks the engine's rpm. However, the fan assembly drive typically incorporates a clutching mechanism such that the fan assembly either assumes an off condition, wherein no airflow is generated by the fan assembly, or an on condition, wherein the fan assembly is driven at a maximum rate established by the engine speed. With such an arrangement, a considerable initial load is placed on the drive system, particularly the belts, when the clutching mechanism is activated while the engine is running at a high rate of speed. Another problem associated with such typical engine cooling arrangements is that there is no control over the amount of power the fan assembly will use. Instead, the horsepower draw on the engine is always at a predetermined power versus fan speed relationship, i.e., power draw is cubic in relation to the rotational speed of the fan, while accounting for air density and temperature factors. This is particularly disadvantageous when cooling needs are low, but the fan assembly is still activated at a high speed. Furthermore, engaging the fan assembly can be a major source of noise, especially at low engine rpm. For instance, when the engine is idling, noise generated by the engagement of the fan can be quite disturbing, with the majority of the noise being produced by the frictional engagement of the elements within the clutching mechanism.

Mainly due to the problems outlined above, variable speed fan assemblies, such as those incorporating viscous and eddy current-type fan clutches, and variable pitch fan assemblies have been developed. In general, variable speed fan assemblies are advantageous as the operating speed of the fan blades can be correlated to the degree of cooling required. Of course, variable speed fan assemblies still only provide a set airflow rate at any given fan operating speed. In addition, viscous drives generally cannot provide a fully "off" condition or a "maximum" airflow condition since they are continuously slipping. Here, variable pitch fan assemblies can be advantageously used since the pitch of the blades can be adjusted according to prevailing cooling requirements such that a reduced power draw from the engine can be achieved. Furthermore, variable pitch fan assemblies can be initially engaged in a smooth and quiet manner, even at low engine speeds, and can readily assume both full off and full on conditions.

As indicated above, a major use for the fan assemblies of concern is to produce an airflow used in cooling an engine of a vehicle. In a vehicle environment, it is known for the engine to be linked to a control module which is part of an overall communications network used to supply operational information to many system components of the vehicle. One particular channel commonly found on such a network is a pulse width modulated signal used to inform the engine cooling system of needed cooling requirements. The signal typically has a frequency range of operation considered to act between 0 and 100%, with a 0% signal indicating that no cooling is needed and a signal of 100% representing that a maximum level of cooling is required.

There exist viscous fan assemblies which utilize the pulse width modulated signal from the engine control module (ECM) to vary the amount of slippage permitted in the rotational drive of the fan assembly. In this manner, the slippage can be regulated to vary the degree of cooling provided. In determining the degree of cooling, various factors need to be considered, such as the fan speed and the geometry, diameter, airfoil shape and angle of attack of the blades. Fixed pitch fan assemblies, as in the case of viscous fans, can be driven at different speeds to vary the created airflow, but the fixed characteristics of the blades only enable these types of fan assemblies to operate efficiently in only a small range of speeds.

Therefore, there exists a need for a fan assembly and system for controlling the same which is designed to establish optimal cooling airflow rates in an efficient manner at any speed of the engine.

SUMMARY OF THE INVENTION

The present invention solves these and other deficiencies and problems related to fan assemblies by providing a control system for a variable pitch fan assembly particularly applicable for use in cooling internal combustion engines.

In accordance with the invention, the fan assembly is adapted to be driven by a motor or engine and readily adjusted during operation to alter airflow characteristics thereof. The fan assembly includes a housing preferably formed from a plurality of mechanically connected housing sections having spaced inner walls so as to define an internal chamber, a plurality of blade units each of which is rotatably supported at circumferentially spaced locations by the housing, and an actuator member interconnected with the blade units such that movement of the actuator member relative to the housing adjusts the pitch of the blade units.

Although various actuator arrangements could be employed, the actuator member preferably constitutes a piston that is adapted to be linearly shifted within the internal chamber such as by introducing a fluid medium, preferably air, therein. A diaphragm is advantageously incorporated between the outlet of the fluid medium and the surface of the piston to minimize drag and facilitate precise piston movement. The piston is interconnected to support stems for the blades such that movement of the piston relative to the housing causes the blade units to rotate to vary the pitch of the fan blades. The force generated by the introduction of the fluid medium to shift the piston must overcome a biasing force exerted on the piston tending to set the fan blades at a maximum airflow pitch.

In accordance with a preferred form of the present invention, the fan assembly is driven by the engine of a vehicle and is used in cooling the engine. A control system is provided which is responsive to at least one signal representative of an operating parameter of the engine and a second signal indicative of a desired cooling requirement to establish an efficient pitch for the blades of the fan assembly. In one preferred form of the invention, the speed of the engine is sensed and used in combination with a cooling requirement signal developed by the engine control module to regulate the pitch of the fan assembly. In a second preferred form of the invention, engine charge air temperature and coolant temperature signals are utilized in establishing the desired pitch. Furthermore, fuzzy logic controls can be utilized to anticipate the cooling needs of the engine based on variations in the overall dynamic system as derived from information available through the engine control module.

It is an object of the invention to provide a control system for regulating the pitch of a fan assembly so as to establish an optimal cooling capacity for an engine.

It is a further object of the invention to provide a control system which is responsive to signals from an engine control module to arrive at the required cooling requirements and to set the blade pitch accordingly.

It is a still further object of the invention to design the control system so as to anticipate the cooling requirements of the engine so that the pitch of the fan assembly can be established proactively.

Additional features and advantages of the fan assembly and control system of the present invention, as well as its method of operation, will become more readily apparent from the following detailed description of preferred embodiments thereof when taken in conjunction with the drawings wherein like reference numerals refer to corresponding parts in the several views.

Figure 1:
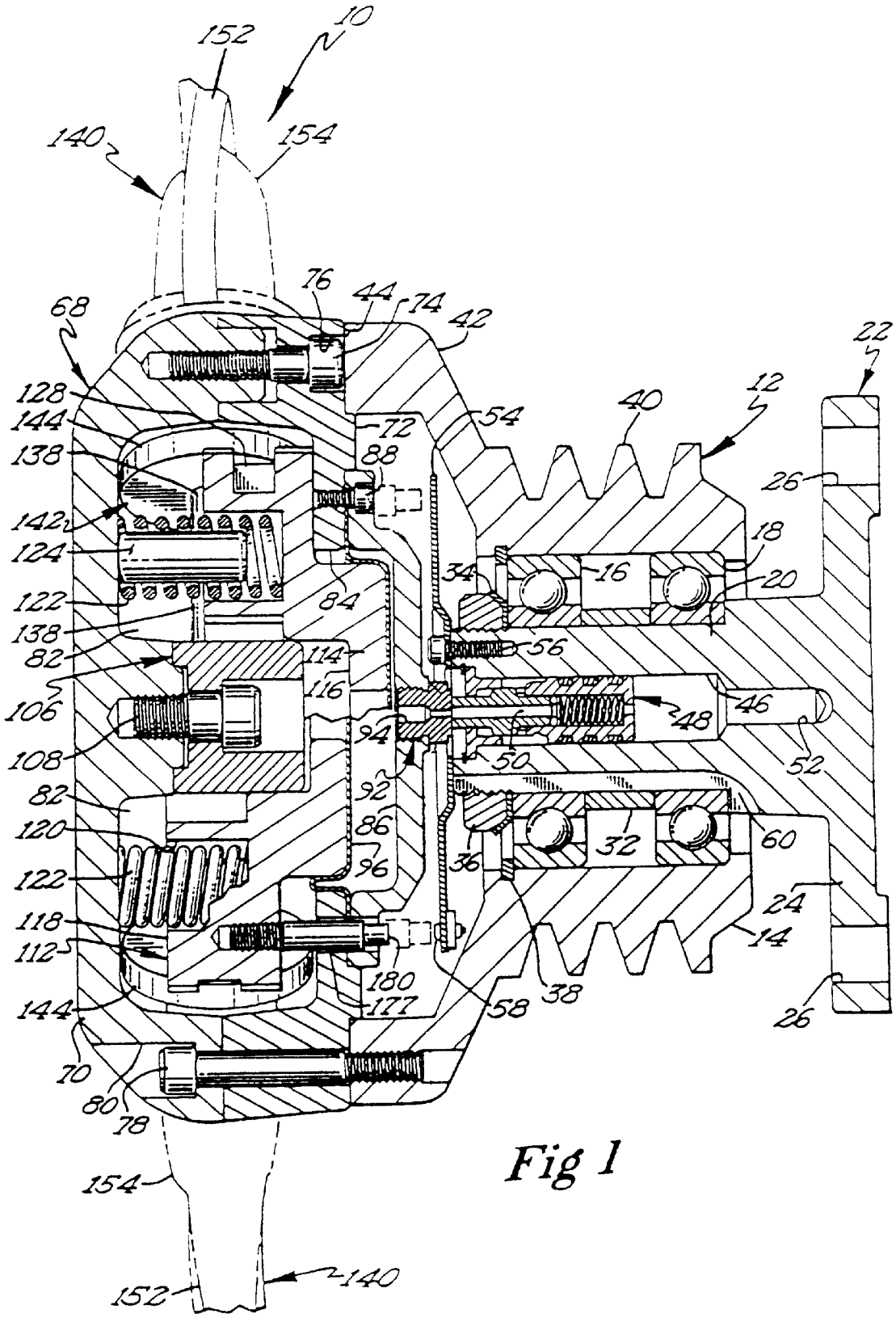
FIG. 1 is a cross-sectional view of a fan assembly used in connection with the control system of the invention, with an actuator member shown in one extreme operating position in the top half of the figure and in another extreme operating position in the lower half.

At this point, it should be noted that all of these figures are drawn for ease of explanation of the basic teachings of the present invention only; the extension of the figures with respect to the number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength and similar requirements will likewise be within the skill of the art after the following teachings of the present invention have been read and understood.

Furthermore, when the terms "first", "second", "inner", "outer", "radially", "axially", "circumferentially" and similar terms are used herein, it should be understood that these terms have reference only to the structure shown in the drawings as it would appear to a person viewing the drawings and are utilized only to facilitate describing the invention.

DETAILED DESCRIPTION OF PREFERRED EMBODIMENTS

The preferred embodiment of a fan assembly according to the preferred teachings of the present invention is shown in the drawings and generally designated 10. In the most preferred embodiment of the present invention, fan assembly 10 is an improvement of the type shown and described in U.S. patent application Ser. No. 08/829,060. For purpose of explanation of the basic teachings of the present invention, the same numerals designate the same or similar parts in the present figures and the figures of U.S. patent application Ser. No. 08/829,060. The description of the common numerals and fan assembly 10 may be found herein and in U.S. patent application Ser. No. 09/829,060, which is hereby incorporated by reference.

In its most preferred form, fan assembly 10 is particularly adapted for use in connection with cooling an internal combustion engine of a vehicle, but other applications for fan assembly 10 of the invention will become readily apparent, such as cooling other types of motors or various other heat generating devices. Therefore, in the preferred application of the invention, fan assembly 10 is shown attached to a drive unit 12 that includes a sheave 14 rotatably mounted through a pair of bearing units 16 and 18 to a stub shaft 20 of a journal bracket 22. Journal bracket 22 also includes a flange portion 24 that is formed integral with stub shaft 20 and which is provided with a plurality of holes 26 for use in fixedly securing journal bracket 22 to an engine block or the like (not shown).

More specifically, bearing units 16 and 18 are press-fit to sheave 14 and stub shaft 20 and are axially separated by a spacer ring 32. The inner races (not separately labeled) of bearing units 16 and 18 are axially maintained on stub shaft 20 by means of a washer 34 and a nut 36 that is threaded onto a terminal end portion of stub shaft 20. Outer races (also not separately labeled) of bearing units 16 and 18 are press-fit against sheave 14 and are retained in a desired axial position by their engagement with sheave 14 and the presence of a retainer ring 38.

Sheave 14 is formed with an outer grooved surface section 40 that is adapted to receive a drive belt that is driven by the internal combustion engine. With this arrangement, sheave 14 is constantly driven during running of the engine. Although various arrangements could be incorporated to vary the relative rotational speeds (drive ratio) between the engine and the sheave 14, such as by simply altering the relative size of the sheave 14 with respect to the drive shaft, in the preferred embodiment, sheave 14 is driven at a 1:1 ratio with the engine. Sheave 14 also includes a generally frustoconical annular drive ring 42 having a terminal axial surface 44.

Stub shaft 20 is formed with an internal bore 46 within which is positioned a fluid supply coupling 48. In general, fluid supply coupling 48 takes the form of a cartridge that is known in the art and therefore will not be detailed here. However, it should be noted that fluid supply coupling 48 includes an internal passage 50 that is adapted to receive a supply of pressurized fluid delivered through an inlet passage 52 formed in journal bracket 22.

Stub shaft 20 has attached thereto a plate 54 by means of fasteners 56. Plate 54 carries at least one sensor 58 which, in the preferred embodiment, is adapted to sense at least one of a blade pitch and an operating speed of fan assembly 10. At this point, although not shown in FIG. 2, it should be recognized that sensor 58 is adapted to be electrically interconnected with a control unit by means of a plurality of wires that are fed to sensor 58 through an axial groove 60 formed in stub shaft 20.

As illustrated, fan assembly 10 includes a housing 68 formed from first and second housing sections 70 and 72 which are adapted to be interconnected at spaced peripheral locations by means of a plurality of first threaded fasteners 74. In the preferred embodiment, first threaded fasteners 74 extend entirely through second housing section 72 and are threaded to first housing section 70 while the head portions of first threaded fasteners 74 are received in countersunk through-holes 76 formed in second housing section 72. Fan assembly 10 is adapted to be attached to sheave 14 by means of a second set of threaded fasteners 78. More specifically, first and second housing sections 70 and 72 are formed with a plurality of aligned through holes 80 which are spaced between countersunk through holes 76 and receive second threaded fasteners 78 for connecting fan assembly 10 to annular drive ring 42 with axial surface 44 of annular drive ring 42 covering the heads of the first threaded fasteners 74. With this arrangement, access to first threaded fasteners 74 is only permitted following detachment of fan assembly 10 from sheave 14.

First and second housing sections 70 and 72 have spaced inner wall portions (not labeled) that define therebetween an internal housing chamber 82. Second housing section 72 is formed with a central opening 84 that leads into internal housing chamber 82. A cover member 86 extends across central opening 84 and is secured to second housing section 72 by various, circumferentially spaced fasteners 88. Cover member 86 is provided with a central aperture within which is threadably secured a coupling 92 having a fluid passage 94. When fan assembly 10 is secured to sheave 14, fluid passage 94 is aligned with internal passage 50 of fluid supply coupling 48 such that pressurized fluid delivered to inlet passage 52 can flow into internal housing chamber 82 through fluid supply coupling 48 and coupling 92. A flexible diaphragm 96 is positioned within internal housing chamber 82 adjacent cover member 86, with flexible diaphragm 96 having an annular peripheral portion sealingly interposed between second housing section 72 and cover member 86. With this arrangement, the flow of pressurized fluid into internal housing chamber 82 will act upon flexible diaphragm 96 to deflect the same.

Attached to first housing section 70, within internal housing chamber 82, is a hub member 106. In the preferred embodiment, hub member 106 is formed separate from first housing section 70 and is secured thereto by means of a recessed bolt 108. Hub member 106 has an outer, preferably cylindrical surface which is adapted to guidingly receive an actuator member 112. In the preferred embodiment, actuator member 112 is constituted by a piston having an end plate portion 114 formed with a cavity 116 opposite hub member 106 and an outwardly extending plate portion 118. Outwardly extending plate portion 118 is provided with various spaced bores 120 which are adapted to receive springs 122 for biasing actuator member 112 towards cover member 86. Springs 122 are maintained in a desired alignment by extending about studs 124 which project into internal housing chamber 82 from first housing section 70.

Actuator member 112 is formed with a plurality of annularly spaced slots 128 and pockets (not shown), each of which receives a post portion 138 of a respective blade unit 140. Post portion 138 forms part of a support stem 142 which includes integral enlarged flange portion 144. Post portion 138 and flange portion 144 of support stem 142 are all preferably formed of metal. Each blade unit 140 includes a fan blade 152 having a base 154. In the preferred embodiment, fan blade 152 is formed of plastic and is molded upon an extension element (not shown) of enlarged flange portion 144 such that the entire blade unit 140 defines an integral unit.

Although the specific number of blade units 140 can vary in accordance with the invention, an equal number of diametrically opposed blade units 140 are preferably provided for dynamic balancing purposes. In the preferred embodiment, the mating of first and second housing sections 70 and 72 provides openings for the receipt of blade units 140. The enlarged flange portion 144 is formed with a hole (not shown) that is eccentric or offset from a longitudinal rotational axis defined by post portion 138. Each hole has secured therein a pin which projects into a corresponding slot 128 formed in actuator member 112. Of course, it should be realized that the pin could also be integrally formed with enlarged flange portion 144. In addition, a bushing (not shown), preferably formed of a lubrication impregnated polymer, could be placed over the pin and received in a respective annular spaced slot 128. In any event, linear shifting of actuator member 112 within internal housing chamber 82 by the introduction of pressurized fluid through fluid passage 94 causes rotation of each blade unit 140 about the longitudinal axis defined by post portion 138 through the interengagement between actuator member 112 and the pin. This rotation of blade unit 140 effectively adjusts the pitch of fan blade 152, thereby altering the airflow characteristics of fan assembly 10. Of course, this shifting of actuator member 112 away from cover member 86 (see lower half of FIG. 1) is performed against the biasing force developed by springs 122, as the biasing force tends to place fan blades 152 in a maximum flow position. The extension of actuator member 112 is limited in the preferred embodiment shown by abutment with the terminal ends of studs 124.

Second housing section 72 and cover member 86 are formed with aligned apertures (not labeled) through which is adapted to extend a respective shaft 177. One end of each shaft 177 is fixed for movement with actuator member 112 relative to housing 68, such as through a threaded connection, and a second end of shaft 177 is preferably provided with a magnet 180. Magnet 180 operates in conjunction with sensor 58 to signal at least one of the pitch of fan blades 152 and the rotational speed thereof. More specifically, sensor 58 functions to sense the presence and strength of the magnetic field generated by magnet 180. As the distance between magnet 180 and sensor 58 directly correlates with the pitch of the fan blades 152 and the timing between passes of the magnet 180 by sensor 58 reflects the operating speed of fan assembly 10, this simple sensing arrangement can provide multiple signals to a control unit for use in regulating the flow of pressurized fluid into internal housing chamber 82.

As indicated above, journal bracket 22 is adapted to be secured to a block portion of the engine via holes 26 of flange portion 24. A drive belt from the engine is then placed around sheave 14 and properly tensioned. Housing 68 of fan assembly 10 can then be readily attached to sheave 14 with the second set of threaded fasteners 78 for concurrent rotary movement. With this arrangement, fan assembly 10 rotates at a speed established by the rotational speed of the engine. However, it is recognized that the actual cooling requirements of the engine do not necessarily track the rotational speed of the engine. As such, the pitch of blade units 140 is controlled to vary the airflow created by fan assembly 10, thereby varying the cooling effect. More specifically, the pressure supplied to shift actuator member 112 is varied through an electronic control in order to change the pitch associated with fan assembly 10 to create an efficient airflow at any speed. At each engine speed, there is a range of blade pitches which would create the most efficient airflow. In accordance with the present invention, an electronic control is utilized to establish the appropriate pressure and, correspondingly, blade pitch angle in order to create an efficient airflow, while avoiding the possibility of stalling or zero airflow which can occur if the pitch angle is set too high or to low.

Figure 2:
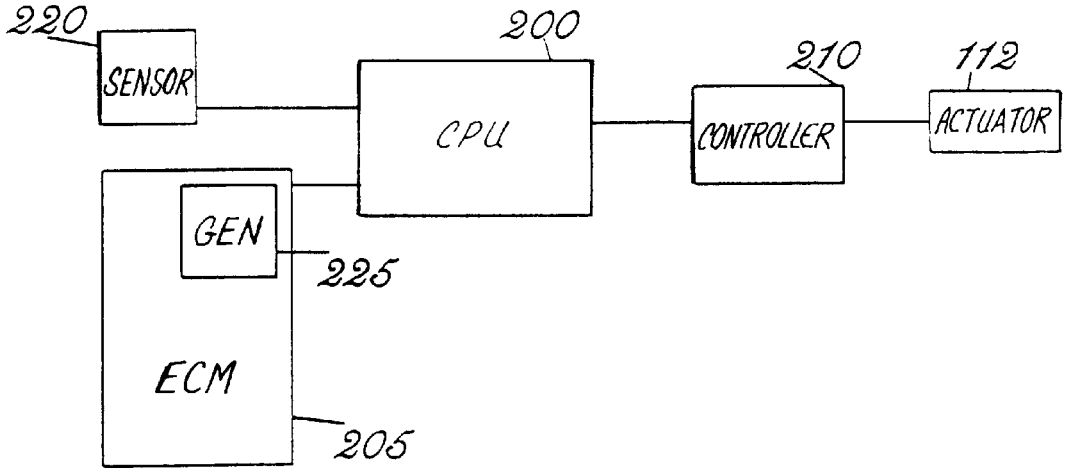
FIG. 2 is a schematic block diagram illustrating a fan pitch control system constructed in accordance with a first embodiment of the invention.

In a first preferred form of the present invention as schematically illustrated in FIG. 2, an electronic control unit or CPU 200 is electrically connected to an electronic control module (ECM) 205 for a vehicle's engine. The CPU 200 has stored therein a matrix of pressure values from which is selected a pressure value that is signaled to a pressure controller 210. Pressure controller 210 provides a supply of pressurized fluid, preferably air, to actuator member 112, thereby adjusting the pitch of blade units 140. CPU 200 receives signals both representative of an operating parameter of the engine and indicative of a desired cooling requirement of the engine. More specifically, in the most preferred form of the invention as encompassed by this embodiment, an engine speed ($E_s$) signal from a speed sensor 220 and a pulse width modulated signal from signal generator 225 of ECM 205 are inputted into CPU 200. Speed sensor 220 is representative of any speed sensing element which can output the necessary data signals. For example, the sensor 58 in combination with the magnet 180 can detect the speed of the engine since fan assembly 10 is driven by and rotates proportionally to, the speed of the engine. Based on the values of these signals, CPU 200 selects from the stored matrix a value which is sent to pressure controller 210.

For example, if the engine speed is at idle, such as between 800–1000 rpm for a diesel truck, and the ECM 205 indicates a need for a 50% cooling level, CPU 200 would signal pressure controller 210 to establish a pressure level of 10 psi (0.7 kg/cm$^2$) in order to move the blade units 140 to a rather aggressive angle of attack. On the other hand, if the engine is running at 2100–2300 rpm, and the ECM 205 calls for the same 50% cooling, the CPU 200 will signal pressure controller 210 to send 40 psi (2.8 kg/cm$^2$) to shift blade units 140 to a smaller angle of attack. Therefore, the higher fan speed coupled with the lower attack angle provides the same 50% cooling level. In a similar manner, CPU 200 can establish the necessary pressure to establish an efficient pitch angle for blade units 140 to achieve the most efficient cooling airflow and minimize engine fuel consumption.

Figure 3:
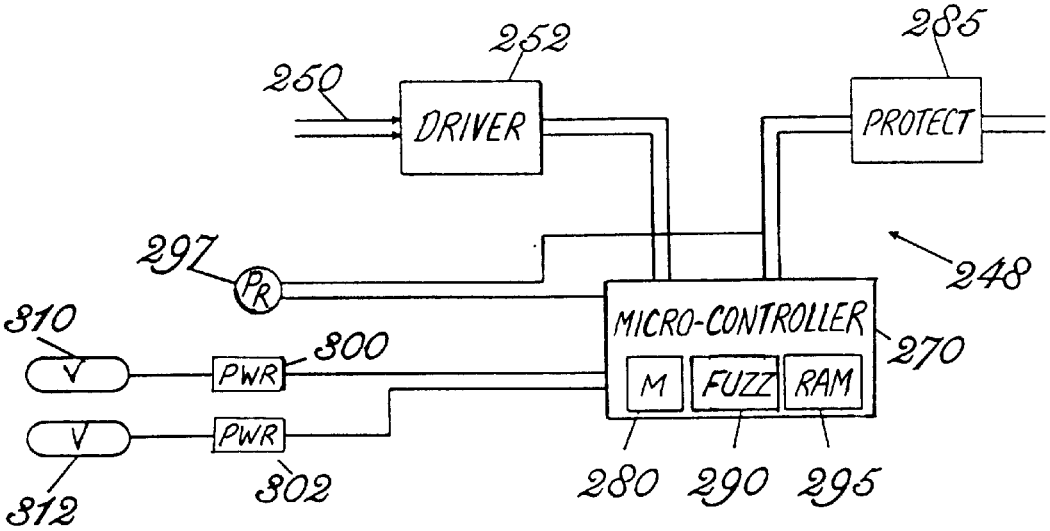
FIG. 3 is a schematic block diagram illustrating a fan pitch control system constructed in accordance with a second embodiment of the invention.

In accordance with a second preferred embodiment of the invention and with reference to FIG. 3, a closed loop adaptive digital control system 248 is provided for regulating an engine cooling system via variable pitch fan assembly 10. The control system of this embodiment monitors at least one engine operating parameter, as well as a desired coolant level. In the most preferred form of the invention, charge air intercooler temperature and an engine coolant temperature are monitored by receiving digital, real time values passed along a serial communications line 250 that is typically shared by various vehicle control units, such as an engine control module (ECM), an ABS brake control, a transmission control and a dashboard/diagnostic controller. The signals are passed through serial communications line 250 via a signal communication driver chip 252. Therefore, obtaining these temperature signals through suitable sensors for use by other vehicle control systems is known in the art and not considered part of the present invention. Instead, the invention is directed to the utilization of these sensed parameters and the manner in which the signals are utilized to proactively determine the necessary cooling requirements for the engine and control the pitch of fan assembly 10 to a calculated one of an essentially infinite number of possibilities, while achieving a minimal airflow rate required to cool the engine in order to minimize power consumption.

As shown in FIG. 3, a micro-controller 270 is used to run an algorithm with inputs from the serial communications line 250. Coupled with the micro-controller 270 is a PROM-type memory 280 which permanently contains a control algorithm, as well as fuzzy logic circuitry 290 (also see FIG. 6). The micro-controller 270 includes a random access memory (RAM) 295 which is used to store system drivers for interfacing with the serial communication line 250 and is connected to a pressure transducer 297 for measuring manifold air pressure, and power transistors 300 and 302 for driving two solenoid valves 310 and 312 used to control the air pressure applied to actuator member 112. A voltage protection and regulation circuit 285 is included to protect micro-controller 270. Solenoid valves 310 and 312 are associated with inlet and outlet ports 314 and 316 of an integral air manifold 320 (see FIG. 7), with the pressure within the manifold being sensed by pressure transducer 297. Air manifold 320 is also connected to an air pressure supply 324.

Figure 4A:
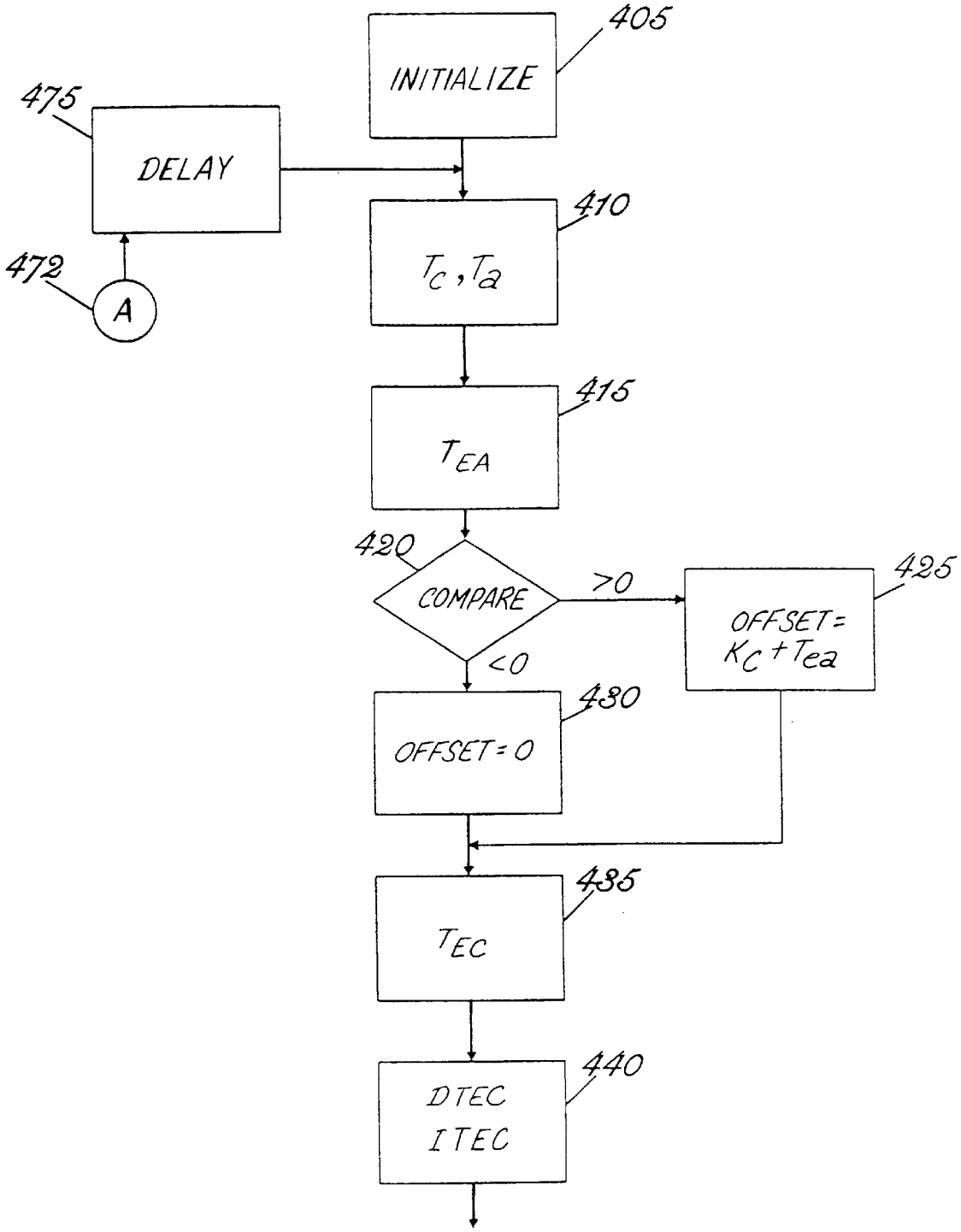
FIGS. 4*a* and 4*b* combine to represent a flow chart of an algorithm followed by the control system of FIG. 3.
Figure 4B:
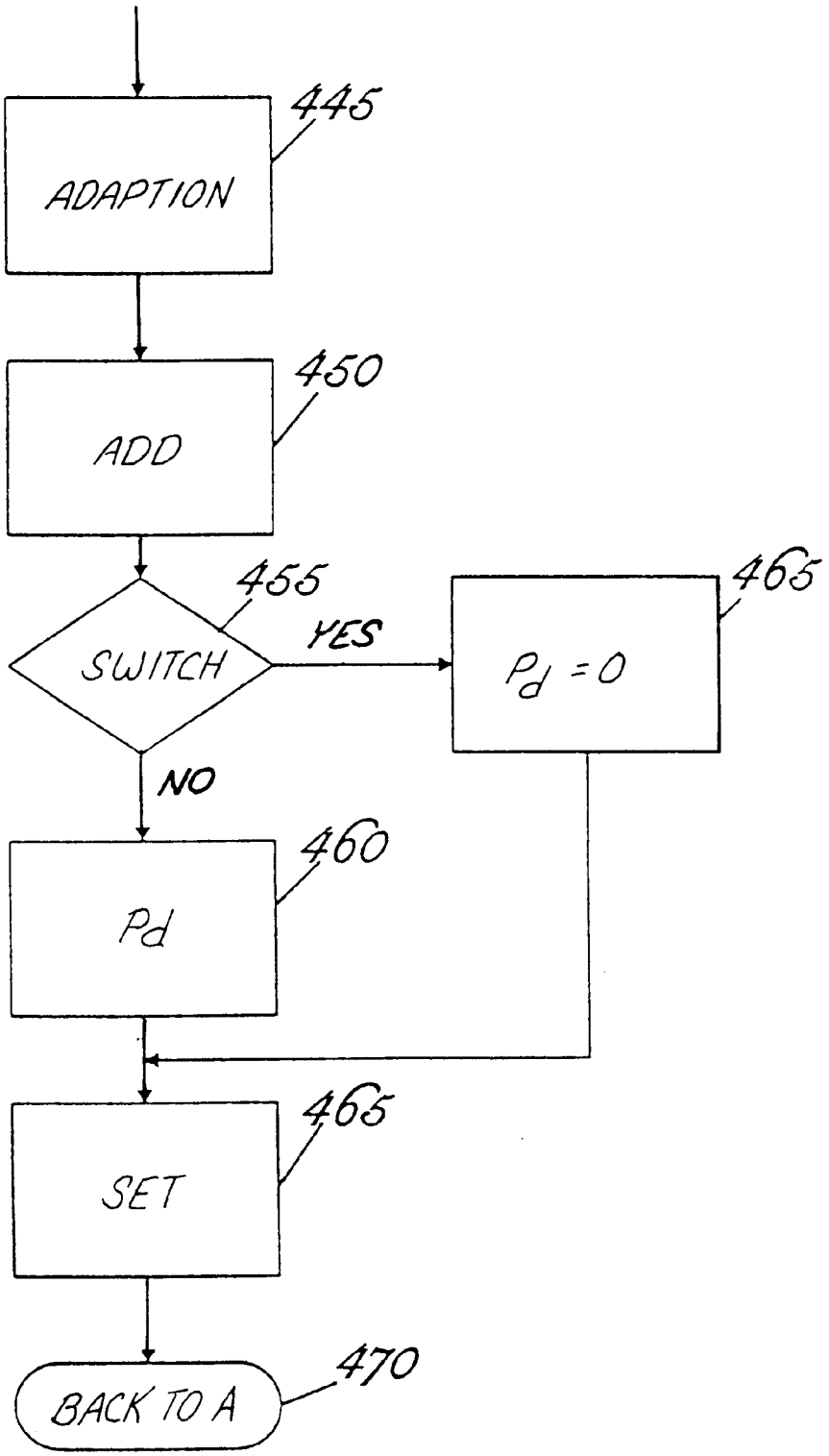

As represented by the algorithm illustrated in FIGS. 4*a* and 4*b*, micro-controller 270 operates based on receiving the coolant and charge air temperatures via the serial data communication line 250 in step 410. More specifically, upon power-up, micro-controller 270 runs the algorithm programmed into the nonvolatile PROM-type memory 280. The algorithm first initializes micro-controller 270 at step 405 and establishes the connection with the serial data communication line 250. Thereafter, a rule value for the fuzzy logic is stored as an array in the internal RAM 295.

Following the initial set-up, the micro-controller 270 obtains the temperature of the engine coolant (Tc) and the temperature at the outlet of the charge air cooler (Ta), i.e., the intake manifold temperature for the engine. Once these values are read, micro-controller 270 calculates an error value for the charge air temperature by subtracting from the charge air temperature a set point value (Tea=Ta−Tas)(step 415). This error value is compared to 0 (step 420) and, if the value is greater than 0 (i.e., positive), an offset is calculated for the coolant temperature set point (offset=Kc*Tea) (step 425). Alternatively, if the error value for the charge air temperature is less than 0, the offset for the coolant temperature set point is established as 0 (step 430). Next, micro-controller 270 calculates an error value (Tec) of the engine coolant temperature relative to a set point value (Tcs) such that the engine coolant temperature is equal to the coolant temperature minus the set point value minus the established offset (Tec=Tc−Tcs−offset) (step 435). Micro-controller 270 then determines the time rate of change of the coolant error ($Dtec=Tec_0-Tec_{-1}$/time lapse) and the integral of the coolant error (ITec=ITec (previous)+Tec*time lapse) (step 440). Thereafter, micro-controller 270 calculates gain adaption values through fuzzy logic controls in step 445. Micro-controller 270 adds the adaption values to the gain values (step 450). If the vehicle air conditioning pressure switch is not activated (step 455), micro-controller 270 calculates the required air pressure value from the control algorithm for the coolant temperature control, i.e., P desired (Pd)=$K_p$*Tec+$K_i$*ITec+$K_d$*Dtec (step 460), wherein $K_p$, $K_d$ & $K_i$ are constant values defined within the system. If the air conditioning pressure switch is active, the P desired (Pd) is set to 0 (step 465). The air pressure used to establish the pitch of blade units 140 is then set (step 465) by the air pressure controller 210. Finally, controller 270 cycles back (step 470) to step 472 and, after a 5 second delay (step 475), repeats the entire algorithm repetitively.

Figure 5:
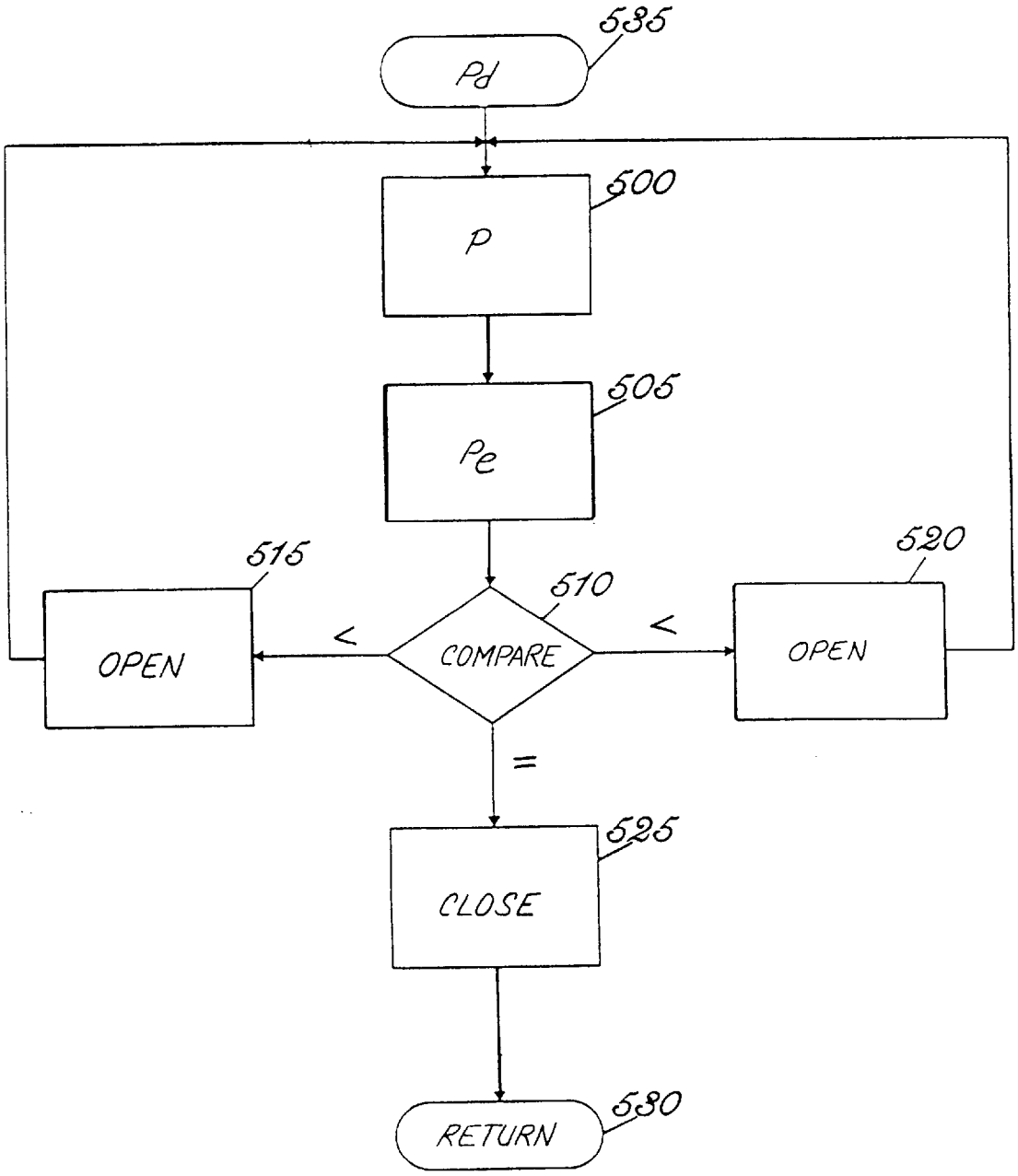
FIG. 5 is a flow chart detailing an algorithm for an actuator used in regulating the pitch of the fan assembly.

FIG. 5 illustrates an algorithm utilized by the air pressure controller 210 to establish the variable pitch of blade units 140. The air pressure control algorithm functions to establish the opening and closing of solenoid valves 310 and 312 to adjust the air pressure supplied to actuator member 112 to the desired value (Pd). This algorithm functions by first receiving a measured manifold air pressure (P) via the pressure transducer 297 (step 500). The value of the air pressure (P) is subtracted from the desired value (Pd) giving an air pressure error value (Pe=P−Pd) in step 505. This error value is compared with a +/− dead band value (db) in step 510. If the pressure error value (Pe) is larger than the positive dead band value (+db), the exhaust valve is opened (step 515) and the air pressure is allowed to drop. Thereafter, the program cycles back to re-measure the manifold air pressure (P). If the pressure error value (Pe) is smaller than the negative dead band value (−db), the inlet valve is opened (step 520) and the air pressure is allowed to increase. Thereafter, the program again cycles back to the point in which the manifold air pressure (P) is measured (step 500). When the air pressure is within the dead band region, both the inlet and exhaust valves are maintained closed (step 525) so as to hold the current air pressure against actuator member 112. In this case, the algorithm returns at step 530 wherein a desired air pressure value (Pd) is received (step 535).

Figure 7:
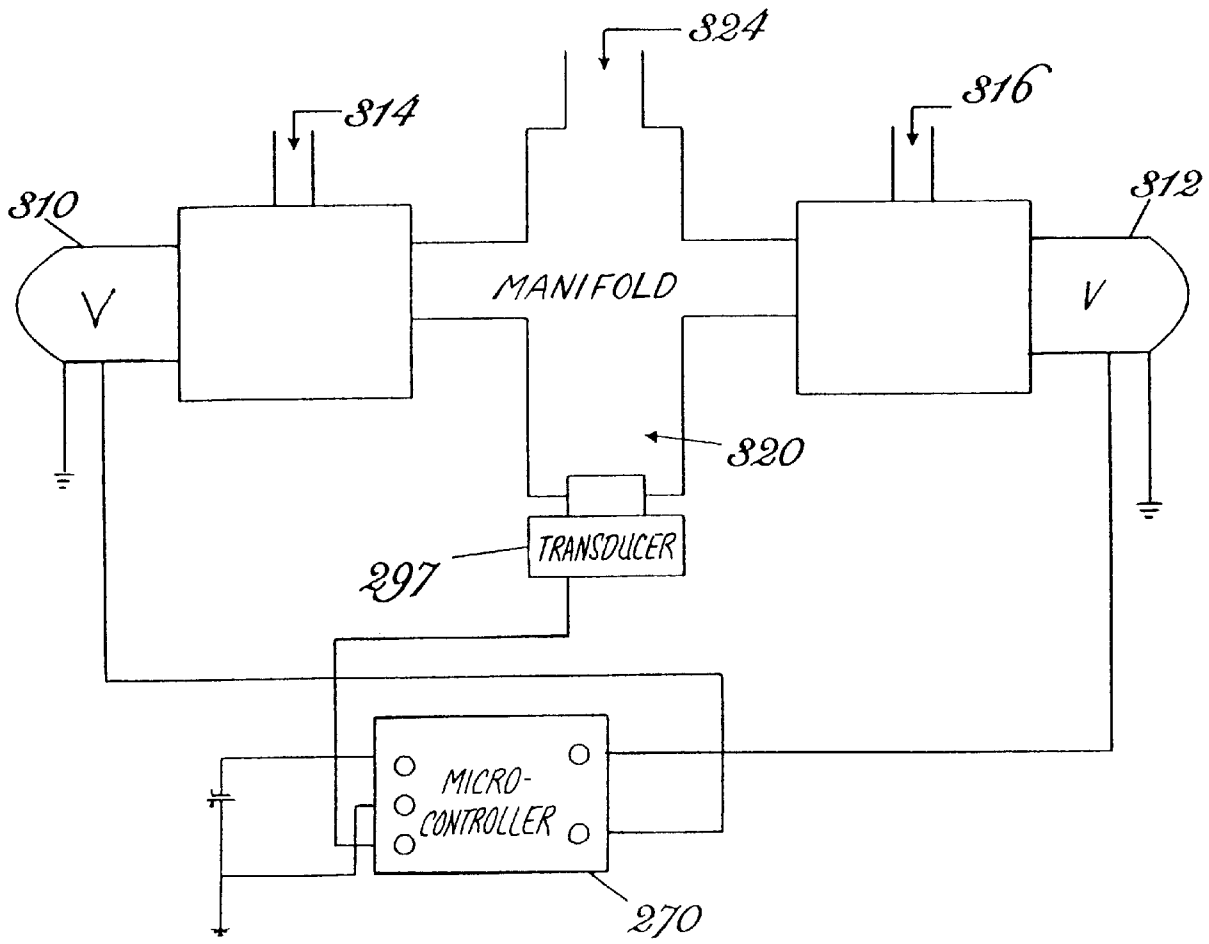
FIG. 7 illustrates a pressure control unit associated with the control systems of the invention.

With this arrangement, the air pressure control value is supplied to fan assembly 10 (correlating to the air pressure supplied to inlet passage 52) through the air manifold 320 and the solenoid valves 310 and 312 are controlled by the air pressure control algorithm. As shown in FIG. 7, the valves on the manifold includes an inlet valve 310 for increasing the air pressure in the manifold via connection to a high pressure air supply, and an exhaust valve 312 for decreasing the air pressure in the manifold to atmosphere. In addition, pressure transducer 297 is in contact with the manifold and produces an electrical signal proportional to the manifold pressure. The manifold itself is connected to the variable pitch fan assembly 10 through air line 324 and is also connected to the supply of high pressure air via a separate line.

Figure 6:
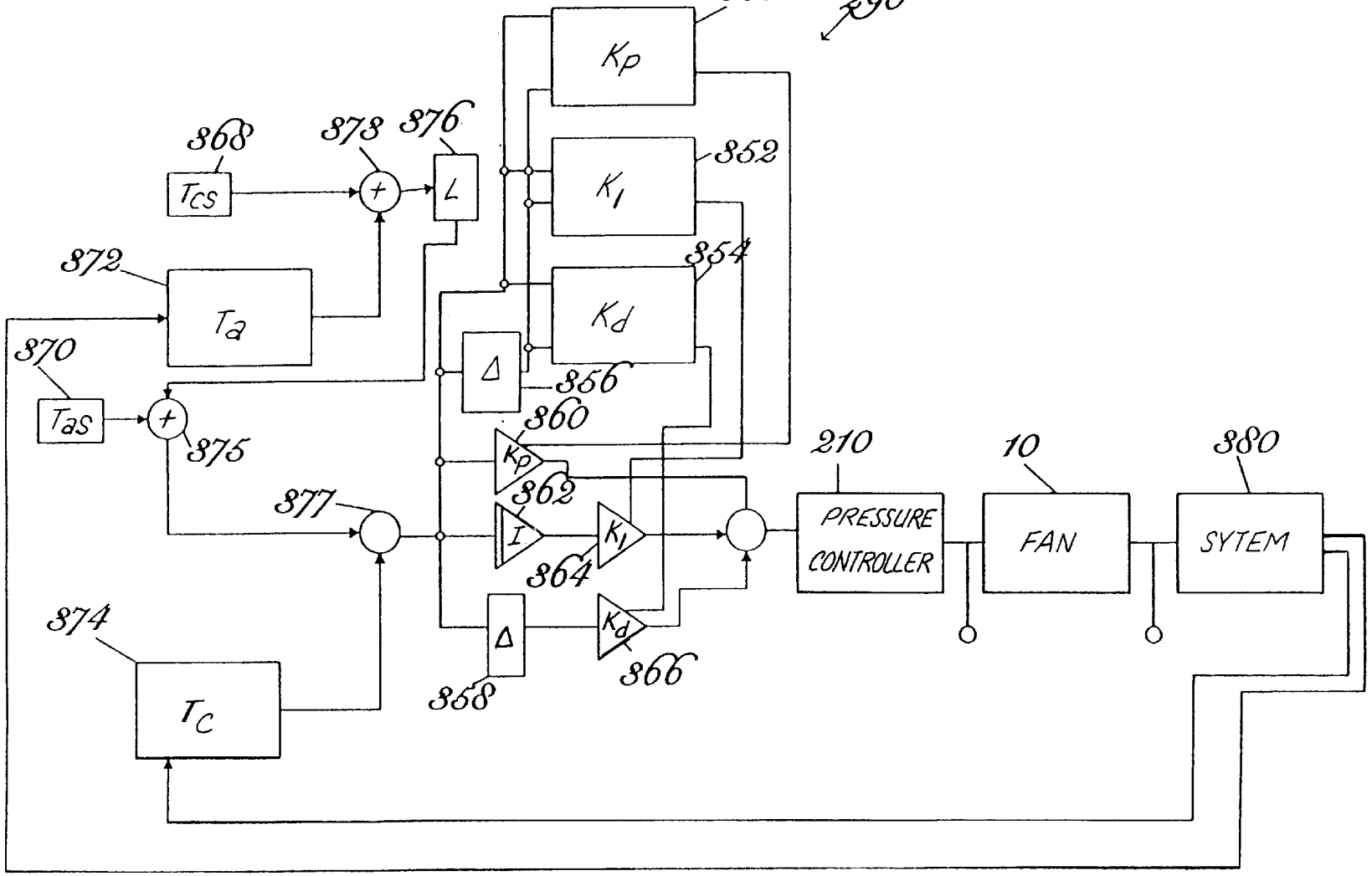
FIG. 6 is a schematic block diagram of a fuzzy logic control system constructed in accordance with the invention.

FIG. 6 illustrate one embodiment of a control system that utilizes fuzzy logic circuitry 290. As described above, various offset values are calculated and utilized during the control sequence. Three tuners 350, 352, and 354 are provided for the constant values of $K_p$, $K_i$, and $K_d$ respectively. Two differential calculators 356 and 358 and an integrator 362 are coupled to the tuners 350, 352, and 354. Each value of $K_p$, $K_i$, and $K_d$ is determined by the tuners 350, 352, and 354 and amplified by a respective amplifier 360, 364, and 366. The charge air set point 368 is summed with the charge air temperature value 372 at summing point 373 and is fed into positive limiter 376. The coolant set point 370, taken from vehicle coolant system 380, is summed with the output of the positive limiter 376 at summing point 375 and this value is summed with the actual coolant temperature value 374 at summing point 377. This value is then fed into the fuzzy logic circuitry 290 and output into pressure controller 210 and ultimately through the remainder of the control system. The output data from the vehicle is then fed back and the cycle is repeated.

In accordance with either of the control embodiments described above, the pitch of fan assembly 10 can be readily adjusted to regulate the airflow of the fan assembly 10 in order to alter the cooling capacity for the engine as required. These controllers function based on sensing an operating parameter of the engine, as well as receiving an indication of a desired cooling requirement for the engine, to establish an infinite cooling capacity range which is a function of the speed at which the fan assembly 10 is driven and the pitch at which the blade units 140 are set. In both of these embodiments, varying the pitch can establish the optimum airflow for cooling purposes, while minimizing fuel consumption of the engine. In at least the second embodiment disclosed, the cooling requirements for the engine can, at least to some extent, be forecasted such that the system proactively adjusts to the necessary cooling requirements.

Now that the basic teachings of the invention according to the preferred embodiments have been set forth, other variations will be obvious to the persons skilled in the art. For example, although the pitch of fan blades 152 are adjusted through the use of a fluid pressure driven actuation system, various actuation systems, including mechanical, electrical, hydraulic and pneumatic systems, could be employed. Therefore, actuator member 112 can take various forms other than a piston while still accomplishing the desired function described above. In addition, it should also be realized that fan blades 152 can assume various shapes, such as providing a twist to increase the efficiency of the airfoil without compromising the articulation of the blade which provides for infinitely variable cooling capacities between a zero capacity to a maximum value based on engine/fan speed. Furthermore, the sensing arrangement is not intended to be limited to the specific embodiment described. Rather, various types of known engine parameters and operating characteristic values could be employed.

Thus the invention disclosed herein may be embodied in other specific forms without departing from the spirit or general characteristics thereof and the embodiment described herein which should be considered in all respects illustrative and not restrictive. The scope of the invention is to be indicated by the appended claims, rather than by the foregoing description, and all changes which come within the meaning and range of equivalence of the claims are intended to be embraced therein.

What is claimed is:

1. A system for controlling a pitch of a fan assembly to regulate an airflow of the fan assembly used in cooling a device comprising, in combination:

means for providing a first signal representative of an operating parameter of the device;

means for providing a second signal indicative of a desired cooling requirement for the device; wherein the second signal constitutes a pulse width modulated signal; and a controller for regulating the pitch of the fan assembly based on the first and second signals.

2. The system of claim 1 wherein the first signal is indicative of a speed at which the fan assembly is rotated.

3. The system of claim 2 wherein the device is a motor and the first signal represents a speed of the motor.

4. The system of claim 3 further comprising, in combination: an electronic module for controlling the operation of the motor, with at least the second signal being received from the electronic module.

5. The system of claim 3 further comprising, in combination: a pressure controlled actuator for adjusting the pitch of the fan assembly based on an output from the controller.

6. A system for controlling a pitch of a fan assembly to regulate an airflow of the fan assembly used in cooling a device comprising, in combination:

means for providing a first signal representative of an operating parameter of the device; wherein the first signal represents charge air temperature;

means for providing a second signal indicative of a desired cooling requirement for the device; and a controller for regulating the pitch of the fan assembly based on the first and second signals.

7. The system of claim 6 wherein the second signal represents measured coolant temperature.

8. The system of claim 7 further comprising, in combination:

means for calculating error values for the charge air and coolant temperatures, with the controller regulating the pitch of the fan assembly to minimize the error values.

9. The system of claim 8 further comprising, in combination:

means for adjusting the charge air temperature signal based on an offset derived from a coolant set point temperature.

10. The system of claim 9 further comprising, in combination:

fuzzy logic circuitry for establishing the pitch of the fan assembly based on changing dynamic variables of the system.

11. The system of claim 6 wherein the first signal is indicative of a speed at which the fan assembly is rotated.

12. A system for controlling a pitch of a fan assembly to regulate an airflow of the fan assembly used in cooling a device comprising, in combination:

means for providing a first signal representative of an operating parameter of the device;

means for providing a second signal indicative of a desired cooling requirement for the device;

a controller for regulating the pitch of the fan assembly based on the first and second signals; and a serial communication bus from which the second signal is received.

13. A system for controlling a pitch of a fan assembly to regulate an airflow of the fan assembly used in cooling a device, wherein the device is an engine, comprising, in combination:

means for providing a first signal representative of an operating parameter of the device;

means for providing a second signal indicative of a desired cooling requirement for the device;

a controller for regulating the pitch of the fan assembly based on the first and second signals;

means for obtaining a temperature of an engine coolant;

means for obtaining a temperature of a charge air cooler;

means for calculating an error value for the temperature of the charge air cooler by subtracting a set point value from the temperature obtained;

means for comparing the error value for the temperature of the charge air cooler to zero and calculating an offset value for the temperature of the engine coolant if the error value for the temperature of the charge air cooler is greater than zero, and setting the offset value to zero if the error value for the temperature of the charge air cooler is less than zero;

means for calculating an error value for the temperature of the engine coolant utilizing the offset value;

means for determining a time rate of change of the error value for the temperature of the engine coolant;

means for determining an integral of the error value for the temperature of the engine coolant;

means for determining a value for required air pressure based upon the error value for the temperature of the engine coolant, the time rate of change of the error value for the temperature of the engine coolant, and the integral of the error value for the temperature of the engine coolant setting the pitch of the fan assembly based on the value for the required air pressure;

means for monitoring actual air pressure within a manifold;

means for comparing the required air pressure to the monitored air pressure; and means for adjusting the set pitch of the fan assembly based on the comparison of the required air pressure to the monitored air pressure.

14. A method of controlling a pitch of a fan assembly to regulate an airflow of the fan assembly used to cool a device comprising:

inputting a first signal, representative of an operation parameter of the device, into a controller;

inputting a second signal, indicative of a desired cooling requirement for the device, into the controller; and outputting a third signal from the controller to regulate the pitch of the fan assembly based on the first and second signals.

15. The method of claim 14 wherein the device is a motor used to rotate the fan assembly and at least one of the first and second signals are obtained from an electronic control module associated with the motor.

16. The method of claim 14 wherein the device is a motor and the first signal input is the speed of the motor.

17. The method of claim 14 wherein the device is a motor and the first signal input represents a charge air temperature.

18. The method of claim 17 wherein the second signal represents measured coolant temperature.

19. The method of claim 14 wherein outputting a third signal to regulate the pitch of the fan assembly further includes varying pressure against an actuator in communication with blades of the fan assembly, causing the actuator to move a predetermined amount, so that movement of the actuator effects a variation in pitch of the blades.

20. The method of claim 14 further comprising:

establishing the pitch of the fan assembly based on changing dynamic variables representative of conditions in and around the device; and utilizing a fuzzy logic circuit to monitor and predict the changing dynamic variables.

21. The method of claim 14 wherein the device is a motor and further comprising:

obtaining a temperature of an engine coolant;

obtaining a temperature of a charge air cooler;

calculating an error value for the temperature of the charge air cooler by subtracting a set point value from the temperature obtained;

comparing the error value for the temperature of the charge air cooler to zero and calculating an offset value for the temperature of the engine coolant if the error value for the temperature of the charge air cooler is greater than zero, and setting the offset value to zero if the error value for the temperature of the charge air cooler is less than zero;

calculating an error value for the temperature of the engine coolant utilizing the offset value;

determining a time rate of change of the error value for the temperature of the engine coolant;

determining an integral of the error value for the temperature of the engine coolant;

determining a value for required air pressure based upon the error value for the temperature of the engine coolant, the time rate of change of the error value for the temperature of the engine coolant, and the integral of the error value for the temperature of the engine coolant setting the pitch of the fan assembly based on the value for the required air pressure;

monitoring actual air pressure within a manifold;

comparing the required air pressure to the monitored air pressure; and adjusting the set pitch of the fan assembly based on the comparison of the required air pressure to the monitored air pressure.

22. The method of claim 14 wherein inputting the second signal comprises inputting the second signal constituting a pulse width modulated signal.

* * * * *

UNITED STATES PATENT AND TRADEMARK OFFICE

CERTIFICATE OF CORRECTION

PATENT NO. : 6,253,716 B1
DATED : July 3, 2001
INVENTOR(S) : Bradford Palmer et al.

It is certified that error appears in the above-identified patent and that said Letters Patent is hereby corrected as shown below:

Title page,
References Cited, under FOREIGN PATENT DOCUMENTS, delete:
58-2111598 12/1983 (JP),
insert:
-- 58-211598 12/1983 (JP) --

Signed and Sealed this

Sixteenth Day of April, 2002

*Attest:*

*Attesting Officer*

JAMES E. ROGAN
*Director of the United States Patent and Trademark Office*